US006378230B1

(12) United States Patent
Rotem et al.

(10) Patent No.: US 6,378,230 B1
(45) Date of Patent: Apr. 30, 2002

(54) LACE-LESS SHOE

(75) Inventors: Gal Rotem; Ofir Shpitzer, both of Nahariya (IL)

(73) Assignee: Visual3D Ltd., Nahariya (IL)

( * ) Notice: Subject to any disclaimer, the term of this patent is extended or adjusted under 35 U.S.C. 154(b) by 0 days.

(21) Appl. No.: 09/705,955

(22) Filed: Nov. 6, 2000

(51) Int. Cl.[7] ..... A43C 11/00; A43B 11/00; A43B 23/26; A43B 5/04

(52) U.S. Cl. ..... 36/50.1; 36/54; 36/51; 36/118.1

(58) Field of Search ..... 36/50.1, 50.5, 36/51, 118.1, 118.2, 138, 114, 54

(56) References Cited

U.S. PATENT DOCUMENTS

| | | | | | |
|---|---|---|---|---|---|
| 4,408,403 | A | * | 10/1983 | Martin | 36/50.1 |
| 4,677,768 | A | * | 7/1987 | Benoit et al. | 36/118.1 |
| 4,694,592 | A | * | 9/1987 | Baggio et al. | 36/50.5 |
| 4,748,751 | A | * | 6/1988 | Sartor | 36/118.1 |
| 4,811,503 | A | * | 3/1989 | Iwama | 36/50.5 |
| 4,924,605 | A | * | 5/1990 | Spademan | 36/114 |
| 4,937,952 | A | * | 7/1990 | Oliveri | 36/50.5 |
| 5,175,949 | A | * | 1/1993 | Seidel | 36/118.1 |
| 5,791,068 | A | * | 8/1998 | Bernier et al. | 36/50.1 |
| 5,839,210 | A | * | 11/1998 | Bernier et al. | 36/50.1 |
| 5,934,599 | A | * | 8/1999 | Hammerslag | 36/50.5 |
| 5,983,530 | A | * | 11/1999 | Chou | 36/50.1 |
| 6,032,387 | A | | 3/2000 | Johnson | |
| 6,035,556 | A | * | 3/2000 | Ballinger et al. | 36/50.1 |

FOREIGN PATENT DOCUMENTS

| | | | | |
|---|---|---|---|---|
| EP | 0317889 | * | 5/1989 | 36/118.2 |
| EP | 0598680 | * | 5/1994 | 36/118.1 |
| JP | 4-92601 | * | 3/1992 | 36/118.1 |

* cited by examiner

*Primary Examiner*—Anthony Stashick
(74) *Attorney, Agent, or Firm*—Mark M. Friedman

(57) ABSTRACT

The present invention relates to a shoe and preferably according to the preferred embodiments to a self-closing mechanism within the shoe. The shoe optionally has an inbuilt mechanical fastening system which operates via insertion of the foot into the shoe which depresses an embedded releasing mechanism in the shoe which pulls closed the fastening-cords of the shoe top tightly around the wearer's foot. Subsequently a lever operated by the companion shoe situated on the back of the shoe body acts as a loosening mechanism enabling removal of the shoe from the wearer's foot.

15 Claims, 5 Drawing Sheets

LACE-LESS SHOE

FIELD AND BACKGROUND OF THE INVENTION

The present invention relates to a shoe and preferably according to the preferred embodiments to a self-closing mechanism within the shoe. The invention is chiefly designed for a self-closing shoe of the sport or athletic shoe variety, but the principles of the invention are applicable to shoes of many other types and styles.

Shoes that incorporate an automated fastening system are known in the prior art. However, none of the automated tightening systems heretofore devised have been entirely successful or satisfactory. Major shortcomings of the automated tightening systems of the prior art are their complexity, in that they involve numerous parts; the inclusion of expensive parts, such as small electric motors; the use of parts needing periodic replacement, e.g. a battery; and the presence of parts requiring frequent maintenance. These aspects, as well as others not specifically mentioned, indicate that considerable improvement is needed in order to attain an automated shoe that is completely successful and satisfactory.

U.S. Pat. No. 6,032,387 describes a shoe whereby energy for closing a shoe is procured by tapping a lever protruding from the heel and releasing the stored energy by tapping an additional lever on the back of the shoe. This shoe would inconveniently demand great agility in order to properly implement the closing and opening of the shoe, together with having to repeat the closing action with the heel numerous times in addition to the real risk of accidentally opening the shoe would make it really inappropriate to a significant proportion of people who would want to have an automated shoe for all of these reasons in addition to its having very many parts.

U.S. Pat. No. 5,791,068 describes a shoe with the same principal of the shoe described in this patent with stored energy while in the open state. However the shoe described involves many more parts including a rigorous casing and needs to be operated by hand.

There is therefore a need for a shoe with a simple mechanism for self-closing and release of the foot from a shoe.

SUMMARY OF THE INVENTION

The general purpose of the present invention is to provide an automated shoe that is devoid of the various shortcomings and drawbacks characteristic of shoes of this sort, which exist, in the prior art. Accordingly, the primary preferred objective of the present invention is to produce an automated tightening shoe, especially a sport or athletic shoe, that automatically tightens comfortably and securely around the wearer's foot from both sides and that has a manual loosening capability. It is a further preferred objective of the present invention to attain the primary objective by providing an automated tightening system which requires no complex or expensive parts, and which includes no parts that need frequent maintenance or periodic replacement. Another preferred objective of the present invention is to provide an automated tightening shoe which is easy to operate and trouble-free in use. Tying shoes using conventional laces is tedious, and tied laces have a propensity to become untied. At best, this is a nuisance to many people. It can present a serious problem to handicapped people who either have difficulty bending over, or whose hands are partially disabled from arthritis or some other cause. People having these handicaps naturally tend toward loafer-type shoes that are pulled onto the feet, or into which the feet can be slipped into without using hands at all. Unfortunately, shoes of this type are never capable of providing the high-level foot support that a good athletic shoe can provide. There is a need, therefore, for a shoe that provides the complete support that a sophisticated athletic shoe, such as a cross-trainer, can provide, but at the same time is so simple to tighten and loosen that even handicapped persons can put their shoes on and take them off without difficulty. Advantages of this invention are that this mechanism enables all people, especially handicapped, obese, weakened, or low-functioning persons or those who have difficulty putting on and taking off laced shoes, to readily lace up and unlace more supportive shoes. A further preferred advantage of this invention is that it provides a shoe having an integral apparatus for automatically tightening the shoe around the foot of the wearer without requiring an expendable power source.

Another preferred advantage of this invention is that it provides a shoe with an integral apparatus, which can be easily actuated to loosen the shoe about the foot of the wearer The shoe is very conveniently fastened around the wearer's foot by simply stepping into the shoe.

According to the teachings of the present invention there is provided a shoe with a self-closing mechanism for receiving a foot of a user, the shoe including a main shoe portion configured for receiving the foot and a top portion associated with a main shoe portion and displaceable between an open position in which the foot may be inserted into and removed from the main shoe portion and a closed position in which a foot is retained within the shoe. A resilient element is associated with the top portion and biased so as to tend to displace the top portion to an open position. There is a closing mechanism including at least one fastening cord passing between the main shoe portion and the top portion and a tensioning element configured to apply tension to the at least one fastening-cord so as to bias the top portion to the closed position, the mechanism being configured to overcome biasing of the resilient element and a releasing mechanism associated with the closing mechanism and configured to assume an activated state in which the releasing mechanism at least partially releases the tension applied by the closing mechanism and a deactivated state in which the tension applied by the closing mechanism is unaffected. The releasing mechanism further includes an actuator configured for causing the releasing mechanism to switch from said activated state to the deactivated state, with the actuator being deployed within the main shoe portion and configured to be operated by insertion of the foot into the main shoe portion.

The releasing mechanism of the shoe further includes a cable connecting the tensioning element to a release lever. The main shoe portion further includes a release lever track associated with the main shoe portion with the release lever being engaged to move up and down on the release lever track wherein displacement of the lever from the upper to the lower position results in the loosening of the fastening cords. The release-lever protrudes sufficiently for a foot-operated downward movement effective to activate tension in the closing mechanism thereby releasing foot. The releasing mechanism further includes a catch associated with the connecting cable employed for selectively retaining the releasing mechanism in the activated state. The actuator in the activated state catches the catch on the connecting cable as the releasing lever is depressed to the lower position as a result of tensioning the tensioning unit. The tensioning element is embedded within the main portion of the shoe and according to one preferred model can be associated with the release lever track.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a shoe with a self-closing mechanism for receiving a foot of a user.

The principles and operation of the self-closing mechanism according to the present invention may be better understood with reference to the drawings and the accompanying description.

Figure 1:
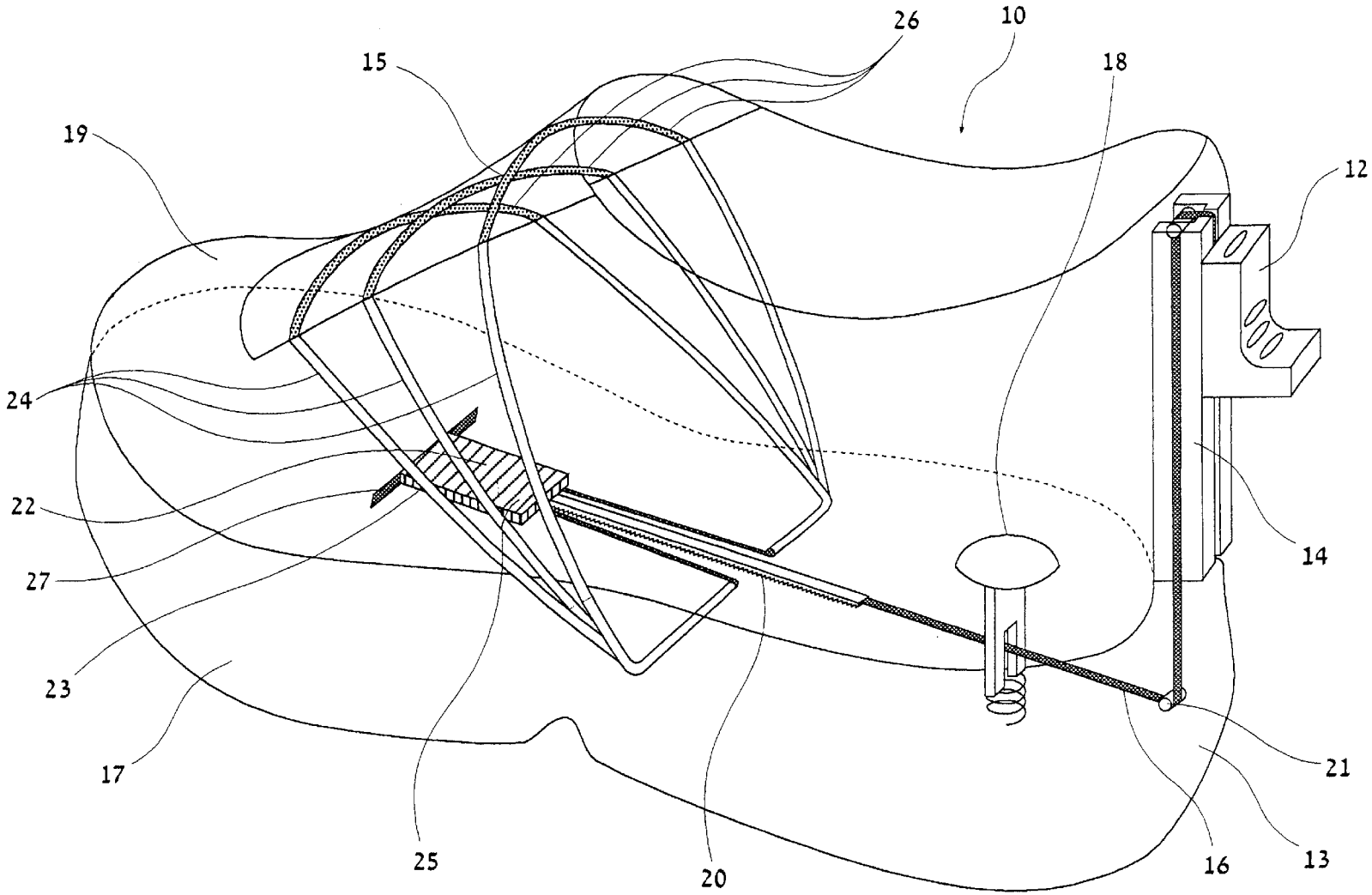
FIG. 1 is an isometric view of a lace-less shoe according to the present invention in the closed position with parts in section and portions cut away to reveal internal details.
Figure 5:
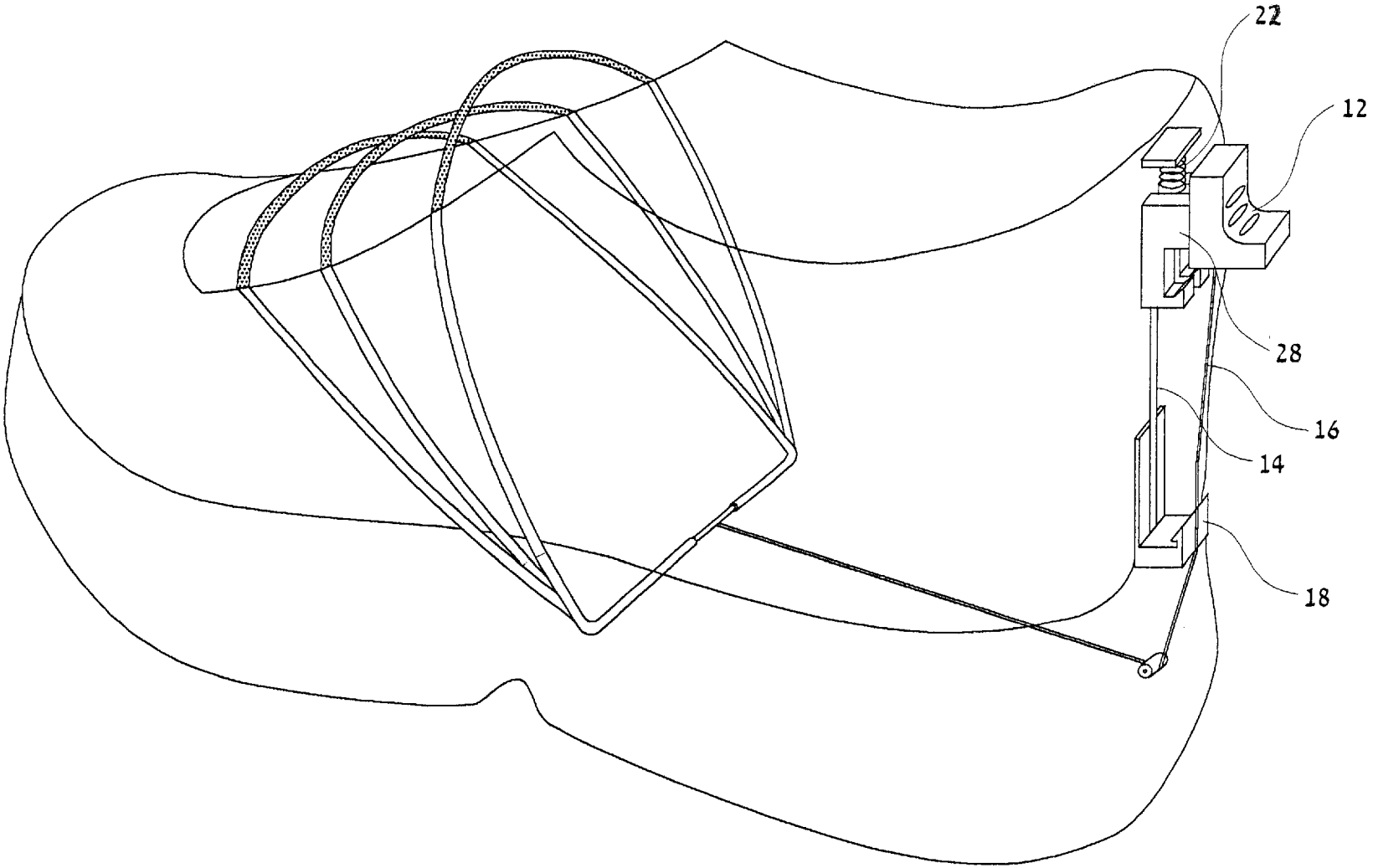
FIG. 5 is an isometric view of a lace-less shoe revealing a variant implementation of the tensioning element this time attached to the release-lever track with the shoe being in the closed position.
Figure 6:
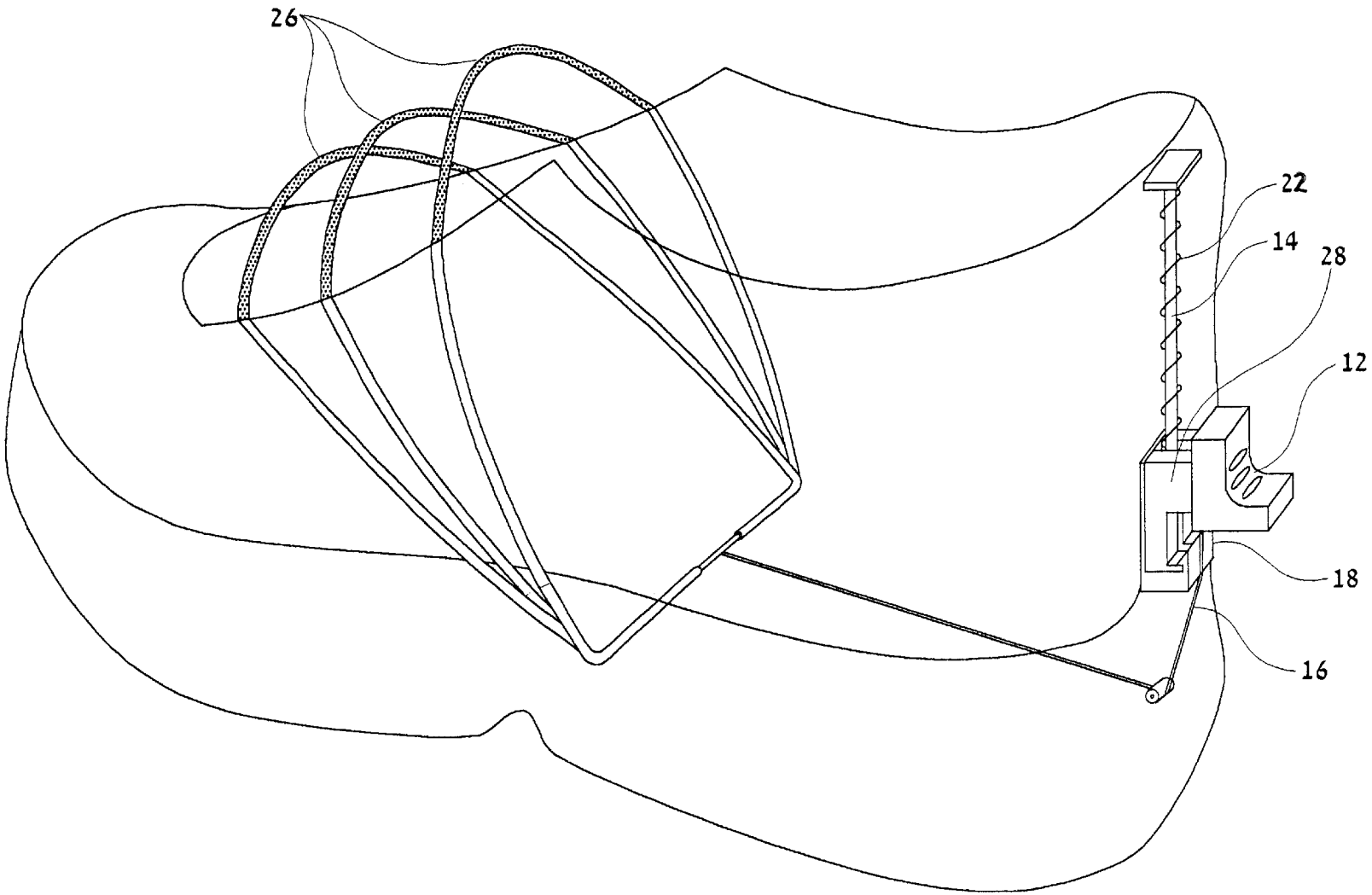
FIG. 6 is similar to FIG. 5 but here the shoe is in the open position.

Referring now to the drawings, FIG. 1 illustrates an isometric view of a lace-less shoe 10 in the closed condition. A sport or athletic shoe is shown here in the diagram only for simplicity's sake as this lace-less mechanism can be designed to fit many types of shoe. The preferred embodiments shown here are only examples of numerous positions associated with the shoe that the tensioning and closing mechanisms can be placed. This shoe preferably has a main shoe portion 19 which includes a sole 17, an upper part 15, the release lever track 14 and on this is the release lever itself 12. The release lever 12 is attached to the connecting cord 16, which runs through the release lever track 14 the continuation of which passes under the guiding rod 21 in the back of the heel section of the sole 13. From here the connecting cord passes through the releasing mechanism 18 to join up with the serrated connecting cord 20. This combination of connecting cord to a serrated connecting cord is only one example of numerous means of catching the connecting cord onto the actuator. The releasing mechanism in this variation of the preferred embodiments includes the serrated connecting cord 20, the connecting cord 16, the release lever track 14 and the release lever 12. The serrated connecting line 20 is connected to the back end 25 of the tensioning element 22 which is also connected to the fastening-cords 26. The front end 23 of the tensioning element 22 is anchored by an anchoring element 27 into the front part of the sole 17 and therefore is immovable. The fastening-cords, or any other similar performing material 26 run through the fastening-cord tracks 24 in the sole 17, shown here as only one example of numerous possible locations, the bottom of which is embedded in the sole 17 and from which at least one fastening-cord track 24 run upwards through both sides of the shoe until the division between the main shoe 19 and the upper portion of the shoe 15. The fastening-cords 26 complete a circuit through the upper portion 15 of the shoe. The upper portion of the shoe 15 opens either manually by the wearer or by a resilient element associated with the upper portion as shown in FIGS. 5 & 6.

Figure 2:
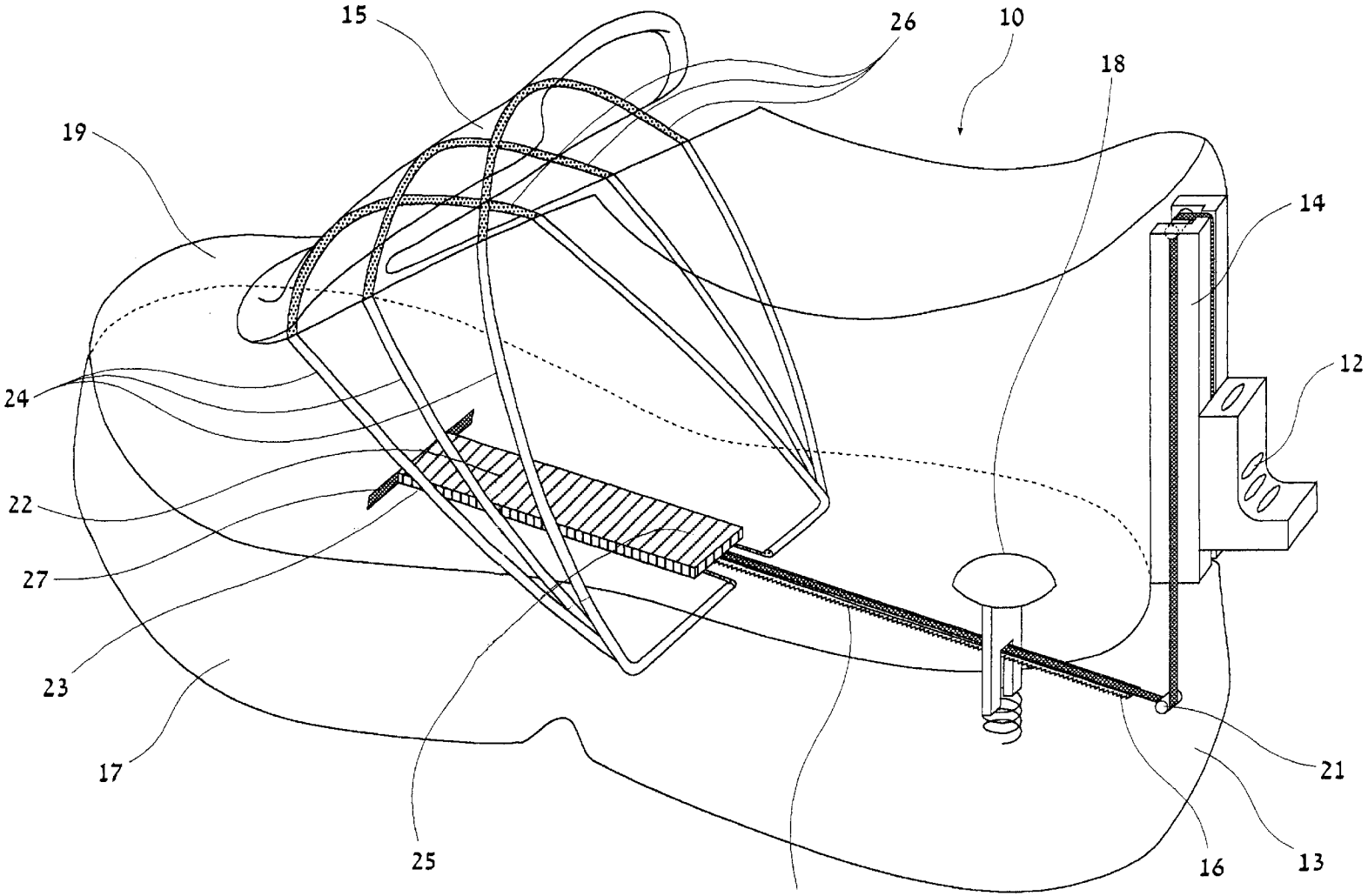
FIG. 2 is a side-view of a lace-less shoe similar to FIG. 1 but in the open position.

FIG. 2 is a side-view of the lace-less shoe 10 in the open condition. The connecting cord 16 is joined with the serrated connecting line 20. The serrated connecting line 20 passes through the release mechanism 18 where it is held in place. The serrated connecting line 20 is connected to the back end 25 of the tensioning element 22 now in a stretched position, which is also connected to the fastening-cords 26. The fastening-cords 26 run through the fastening-cord tracks 24 the bottom of which is embedded in the sole 17 and from which a number of individual fastening-cord tracks 24 run upwards through both sides of the shoe until the division between the main portion 19 of the shoe and the upper potion 15. The fastening-cords 26 complete a circuit through the upper portion 15.

Figure 3:
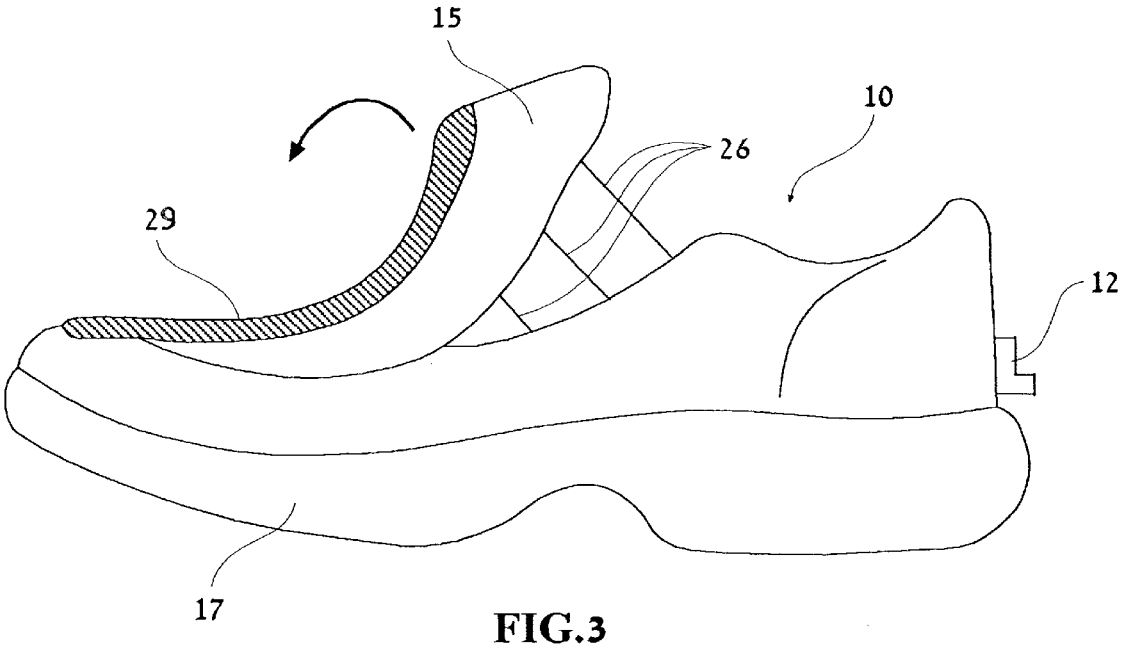
FIG. 3 is a side-view of a lace-less shoe, the present invention in the open position with parts in section and portions cut away to reveal a variant implementation of the internal retracting element embedded into the upper portion of the shoe in a concave open position.

FIG. 3 is a side-view of the lace-less shoe, the present invention in the open position with parts in section and portions cut away to reveal an optional the internal resilient element 29 embedded into the upper portion 15 of the shoe in the concave open position. The upper portion 15 of the shoe is configured to mate the main portion of the shoe and may be consistent in constitution or have parts of it cut away in a sandal like form. This is an example of many types of resilient elements. The release lever 12 is in the depressed position, which stretches the tensioning element. This releases the plurality of fastening-cords 26, with an optional number of 3 fastening cords, shown here. The released slack is taken up by the upper portion 15 of the shoe as a result of the resilient element 29 returning to its biased concave position.

In operation, the shoe has reached the open position by the wearer preferably using his companion shoe to depress the release-lever 12. This in turn pulls the connecting cord 16, which pulls the serrated connecting cord 20 through the actuator 18 and becomes caught on a catch within the actuator 18. This simultaneously stretches the tensioning element shown here in a preferred embodiment as a rubber strip 25. Stretching the tensioning element 25 results in loosening of the fastening cords. The released slack is taken up by the upper portion 15 of the shoe as a result of the resilient element 29 returning to its biased concave position resulting in the opening of the shoe. The shoe described in the preferred embodiments is closed by the wearer placing a foot in the shoe and depressing the actuator, which releases the connecting cords 16 & 20. The rubber strip 25 retracts simultaneously pulling the connecting cords 16 & 20 and the plurality of fastening cords 26 towards the front end of the shoe. This results in the closing of the upper part of the shoe 19 around the foot of the wearer.

Figure 4:
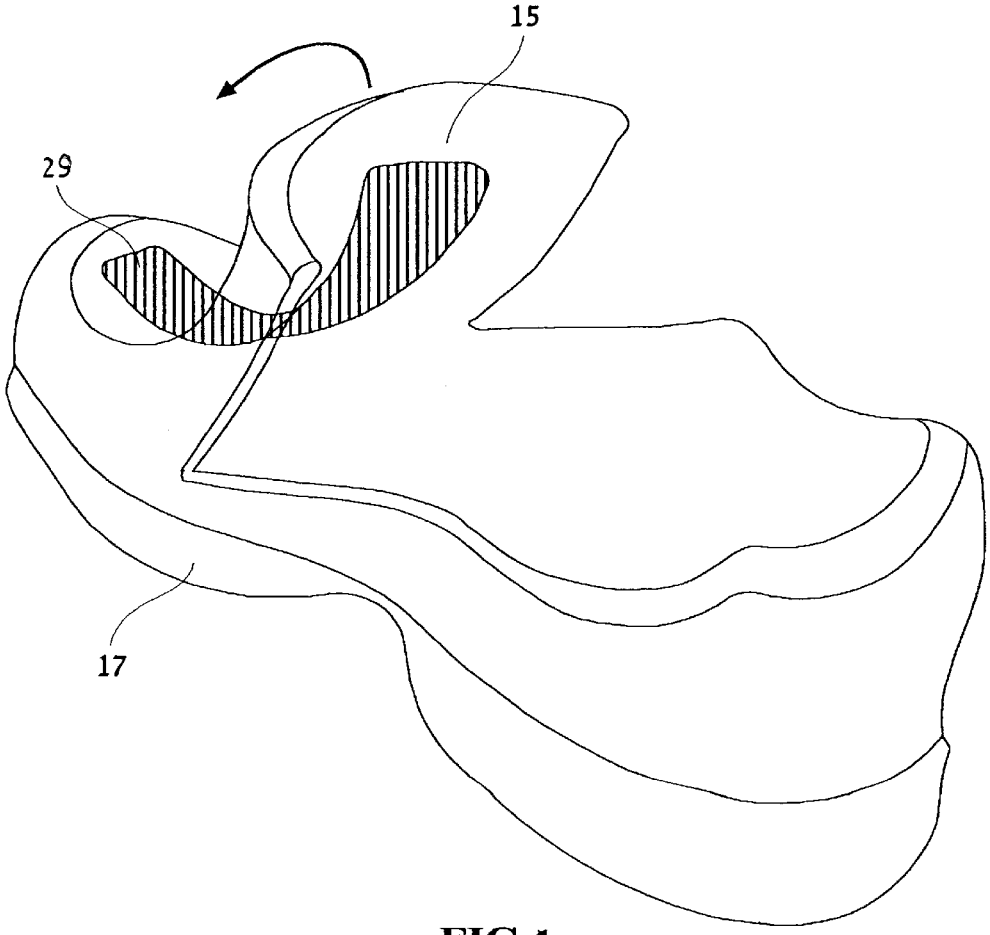
FIG. 4 is a perspective view of a lace-less shoe similar to FIG. 3 but here illustrating the resilient effect of the top portion of the shoe.

FIG. 4 is an additional view illustrating the relationship between the fastening cords 26 and the upper portion of the shoe 15.

FIG. 5 is an isometric view of a closed lace-less shoe revealing a variant implementation of the tensioning element. In this example the tensioning element 25 and the releasing mechanism 18 are associated with the release-lever track 14. The connecting cord 16 is attached to the release lever 12 which is attached to the catch 28 which runs up and down on the release lever track 14. The tensioning element, which is in this variation of the preferred embodiments, is illustrated as a helical tension spring 25 is shown in its biased form.

The mode of operation in this variation of the preferred embodiments illustrated here is similar to the mode of operation to the variant described in FIG. 3 with some of the exceptions being the tensioning element 25 being a helical tension spring and the actuator of the releasing mechanism 18 being embedded in the hind section of the shoe and not embedded in the sole.

FIG. 6 is an isometric view of an open lace-less shoe illustrating the stretched tensioning element 25 held in position by the catch 28 held in position by the releasing mechanism 18. The shoe is closed by the placing of foot inside the shoe which displaces the catch 28 from the releasing mechanism 18 resulting in the tensioning of the tensioning element 25 deployed around a shaft simultaneously serving as the release-lever track 14 which pulls the connecting cords 26 to result in closing the shoe over the wearer's foot.

The mode of operation in this variation of the preferred embodiments illustrated here is similar to the mode of operation to the variant described in FIG. 3 with some of the exceptions being the tensioning element 25 being a helical tension spring and the actuator of the releasing mechanism 18 being embedded in the hind section of the shoe and not embedded in the sole.

FIG. 6 is an isometric view of an open lace-less shoe illustrating the stretched tensioning element 25 held in position by the catch 28 held in position by the releasing mechanism 18. The shoe is closed by the placing of foot inside the shoe which displaces the catch 28 from the releasing mechanism 18 resulting in the tensioning of the tensioning element 25 deployed around a shaft simultaneously serving as the release-lever track 14 which pulls the connecting cords 26 to result in closing the shoe over the wearer's foot.

It will be appreciated that the above descriptions are intended only to serve as examples, and that many other embodiments are possible within the spirit and the scope of the present invention.

What is claimed is:

1. A shoe with a self-closing mechanism for receiving a foot of a user, the shoe comprising:

(a) a main shoe portion configured for receiving the foot;

(b) a top portion associated with said main shoe portion and displaceable between an open position in which the foot may be inserted into and removed from the main shoe portion and a closed position in which a foot is retained within the shoe;

(c) a resilient opening element associated with said top portion biasing said top portion to said open position;

(d) a closing mechanism including at least one fastening-cord passing between said main shoe portion and said top portion and a resilient tensioning element configured to apply tension to said at least one fastening-cord sufficient to overcome biasing of said resilient opening element;

(e) a releasing mechanism associated with said closing mechanism and configured to assume an activated state in which said releasing mechanism at least partially releases said tension applied by said closing mechanism and a deactivated state in which said tension applied by said closing mechanism is unaffected.

2. The shoe of claim 1, wherein said releasing mechanism further includes an actuator configured for causing said releasing mechanism to switch from said activated state to said deactivated state, said actuator being deployed within said main shoe portion and configured to be operated by insertion of the foot into said main shoe portion.

3. The shoe of claim 1, wherein said releasing mechanism farther includes a cable connecting said tensioning element to a release lever.

4. The shoe of claim 3, wherein said main shoe portion further comprises a release lever track associated with said main shoe portion with said release lever being engaged to move up and down on said release lever track wherein displacement of the lever from the upper to the lower position results in the loosening of the said fastening cords.

5. The shoe of claim 4, wherein said release-lever protrudes sufficiently for a foot-operated downward movement effective to activate tension in said closing mechanism thereby releasing foot.

6. The shoe of claim 3, wherein said releasing mechanism further includes a catch associated with said connecting cable employed for selectively retaining said releasing mechanism in said activated state.

7. The shoe of claim 6, wherein said releasing mechanism further includes an actuator configured for causing said releasing mechanism to switch from said activated state to said deactivated state, said actuator being deployed within said main shoe portion and configured to be operated by insertion of the foot into said main shoe portion.

8. The shoe of claim 1, wherein said tensioning element is embedded within the body of said main portion of the shoe.

9. The shoe of claim 8, wherein said resilient tensioning element is associated with said release lever.

10. A shoe with a self-closing mechanism for receiving a foot of a user, the shoe comprising:

(a) a main shoe portion configured for receiving the foot;

(b) a top portion associated with said main shoe portion and displaceable between an open position in which the foot may be inserted into and removed from the main shoe portion and a closed position in which a foot is retained within the shoe;

(c) a closing mechanism including at least one fastening-cord passing between said main shoe portion and said top portion and a resilient tensioning element configured to apply tension to said at least one fastening-cord so as to bias said top portion to said closed position;

(d) a releasing mechanism associated with said resilient closing mechanism and configured to assume an activated state in which said releasing mechanism at least partially releases said tension applied by said resilient closing mechanism and a deactivated state in which said tension applied by said resilient closing mechanism is unaffected, said releasing mechanism including:

(i) a cable connecting said resilient tensioning element to a release lever;

(ii) a catch associated with said connecting cable employed for selectively retaining said releasing mechanism in said activated state; and (iii) an actuator configured for causing said releasing mechanism to switch from said activated state to said deactivated state, said actuator being deployed within said main shoe portion and configured to be operated by insertion of the foot into said main shoe portion.

11. The shoe of claim 10, further comprising a resilient opening element associated with said top portion and biasing said top portion to said open position, wherein said closing mechanism is configured to overcome biasing of said resilient opening element such that, when said releasing mechanism assumes said deactivated state, said resilient opening element displaces said top portion to said open position.

12. The shoe of claim 11, wherein said main shoe portion further comprises a release lever track associated with said main shoe portion with said release lever being engaged to move up and down on said release lever track wherein displacement of the lever from the upper to the lower position results in the loosening of the said fastening cords.

13. The shoe of claim 12, wherein said release-lever protrudes sufficiently for a foot-operated downward movement effective to activate tension in said closing mechanism thereby releasing foot.

14. The shoe of claim 10, wherein said tensioning element is embedded within the body of said main portion of the shoe.

15. The shoe of claim 14, wherein said resilient tensioning element is associated with said release lever.

* * * * *

UNITED STATES PATENT AND TRADEMARK OFFICE

CERTIFICATE OF CORRECTION

PATENT NO. : 6,378,230 B1
DATED : April 30, 2002
INVENTOR(S) : Rotem

It is certified that error appears in the above-identified patent and that said Letters Patent is hereby corrected as shown below:

Please amend as follows:
Between column 4 line 48 to column 5 line 37, in all places where "25" appears it should be "22".

Signed and Sealed this

Second Day of July, 2002

*Attest:*

*Attesting Officer*

JAMES E. ROGAN
*Director of the United States Patent and Trademark Office*